US006336602B1

(12) United States Patent
Miles

(10) Patent No.: US 6,336,602 B1
(45) Date of Patent: Jan. 8, 2002

(54) LOW SPEED LOW INTENSITY CHIP REFINING

(75) Inventor: Keith Miles, Montreal (CA)

(73) Assignee: Pulp and Paper Research Institute of Canada, Pointe Claire (CA)

( * ) Notice: Subject to any disclaimer, the term of this patent is extended or adjusted under 35 U.S.C. 154(b) by 0 days.

(21) Appl. No.: 09/316,948

(22) Filed: May 24, 1999

Related U.S. Application Data

(60) Provisional application No. 60/086,877, filed on May 27, 1998.

(51) Int. Cl.[7] ..... B02C 7/14
(52) U.S. Cl. ..... 241/28; 241/29; 241/36
(58) Field of Search ..... 241/28, 29, 36, 241/261.2

(56) References Cited

U.S. PATENT DOCUMENTS 2,035,994 A * 3/1936 Sutherland, Jr.
3,411,720 A * 11/1968 Jones et al.
4,661,911 A * 4/1987 Ellery, Sr. ..... 241/36 X
4,700,900 A * 10/1987 Rowland ..... 241/37
5,167,373 A * 12/1992 Bohn et al.
5,248,099 A * 9/1993 Lahner et al.
5,335,865 A * 8/1994 Kohler et al.
5,540,392 A * 7/1996 Broderick et al.
5,624,616 A 4/1997 Brooks

OTHER PUBLICATIONS

Refining Intensity, Energy Consumption and Pulp Quality in Two–Stage Chip Refining, Mar. 1991 Tappi Journal, pp. 221–230.*
The Effect on First–Stage Refining Conditions on Pulp Properties and Energy Consumption, Stationwala et al, Journal of Pulp and Paper Science: vol. 19, No. 1, Jan. 1992, pp. J12–J18.*
The Flow of Pulp in Chip Refiners, Miles et al, Journal of Pulp and Paper Science, vol. 16, No. 2, Mar. 1990, pp. J63–J72.*
A Simplified Method for Calculating the Residence Time and Refining Intensity in a Chip Refiner, Paperi ja Puu—Paper and Timber 73(1991):9, pp. 852–857.

* cited by examiner

*Primary Examiner*—John M. Husar
(74) *Attorney, Agent, or Firm*—Swabey Ogilvy Renault

(57) ABSTRACT

In the mechanical refining of wood chips to produce wood pulp, wood pulp quality is improved by employing low refining intensity at least in a final refining stage; the refining is carried out in a double disc refiner or a single disc refiner at rotational speeds that are lower than those conventionally employed, specifically at less than 1200 RPM in a double disc refiner and at less than 1500 RPM in a single disc refiner.

51 Claims, 9 Drawing Sheets

LOW SPEED LOW INTENSITY CHIP REFINING

CROSS-REFERENCE TO RELATED APPLICATION

This Application is related to U.S. Provisional Application S.N. 60/086,877, filed May 27, 1998, and the benefit under 35 U.S.C. 119(e) of such U.S. Provisional Application is claimed.

BACKGROUND OF THE INVENTION i) Field of Invention

The present invention relates to the mechanical refining of wood chips to produce wood pulp and more particularly, to a method of producing uniform and superior quality pulp from wood chips with disc refiners employing low intensity refining.

ii) Description of the Prior Art

In recent years there has been a considerable amount of both theoretical and experimental research into the factors governing fibre residence time in wood chip refiners. This has led to the concept of refining intensity, defined as the specific energy delivered per bar impact. The constitutive equations for material flows within refiners developed by Miles and May (J. Pulp Paper Sci. 16(2): J63(1990) and Paperi ja Puu 73(9):852(1991) can be used to calculate pulp velocity and the corresponding residence time of the pulp in the refiner. The residence time determines the specific energy per bar impact which Miles and May defined as refining intensity. Currently, many developments in mechanical pulping are focussed on reducing energy consumption while maintaining pulp quality at a desirable level. The refining intensity, which is a deciding factor for the quality of pulp produced at a given total specific energy, is itself highly dependent on the rotational speed of the refiner. In current commercial systems, the rotational speed of the refiner is determined by the frequency of the electrical supply, so that double disc refiners run at either 1200 or 1500 RPM and single disc refiners at 1500 or 1800 RPM. Therefore, regardless of the process requirements, the refining intensity is fixed by the system design and local generating frequency.

Jones et al (U.S. Pat. No. 3,411,720) disclose that mechanical pulp with greater strength could be produced by devising a refining process in which the amount of energy absorbed by the wood material is increased. They achieve this by increasing the residence time of the pulp in the refiner using a combination of sinuous plates or tapered plates and control rings on the periphery of the plates. Although they specified relative speeds of between 900 and 3600 RPM the process was never proven to be practical or effective.

Other methods to change the pulp residence time and the applied energy by changing the steam flow within zones in a refiner, have been reported. U.S. Pat. No. 5,335,865 discloses removing some of the steam from a first refining zone before it enters a second zone, or from the first two refining zones before entering a third (U.S. Pat. No. 5,248,099). These methods are based on the mistaken belief that steam and pulp velocities are equal. Steam flow has little effect on either average pulp velocity or residence time as calculated by Miles, Paperi ja Puu 73 (9):852(1991).

U.S. Pat. No. 2,035,994 discloses using variable disc speed to control pulp throughput using a stock refiner. A stock refiner is different from a mechanical disc refiner in that the stock refiner is employed to refine pulp while a mechanical disc refiner is used to refine wood chips. The process operates at low consistencies (3 to 6%) and rotational speeds (300 to 900 RPM). While these conditions are suitable for small modifications and improvements to pulp fibres before papermaking they are not suitable for refining wood chips into pulp fibres.

In an effort to circumvent the limitations imposed by electrical frequency and to reduce specific energy consumption in a single disc refiner, one equipment supplier has advocated an increase in refining intensity by employing a gearbox to raise the rotational speed to 2300 RPM. Similarly, in a double disc refiner (U.S. Pat. No. 5,167,373), an increase in feed-end speed from 1200 to 1800 RPM (U.S. Pat. No. 5,167,373) is advocated. However, these approaches do not account for situations where a fixed high level of refining intensity may not be appropriate for different raw materials and end product requirements.

Operating at higher than conventional disc speeds has been most effective when the first refining stage was operated at high refining intensity and the second stage was operated conventionally. (Tappi Journal 74(3):221(1991) and J. of Pulp Paper Sci. 19(1):J12(1993)). The optimum energy saving at desired pulp and fibre properties was obtained by employing a smaller portion of the total specific energy in the first, high intensity stage. A typical split in specific energy between the first and second stages of refining would be 40/60. Increasing further the refining intensity or the proportion of the specific energy applied in the first stage lowers the total energy required to reach a given freeness. However, it also lowers the average fibre length and pulp strength, limiting the advantage of the energy savings that was reported.

U.S. Pat. No. 5,540,392, issued to Broderick et al. discloses that it is possible to reduce energy by up to 18% in a two-stage refining system. At least 65% of the total energy is applied in a low intensity first stage refiner operating at conventional disc rotational speeds. Low refining intensity was achieved by raising the consistency from 26 to 30%. The remaining energy is applied in a high intensity second stage refiner. The pulp properties are reported to be at least as good as or better than that produced by conventional refiners although all their examples are for highly sulphonated pulps.

There is no known approach in the prior art that addresses the need to reduce refining intensity below conventional levels in order to improve the quality of wood fibres.

SUMMARY OF THE INVENTION

It is an object of this invention to provide a method for mechanically refining wood chips to produce wood pulp exploiting low refining intensity achieved by rotating impact members which are rotated at speeds lower than conventional speeds.

It is a further object of the invention to provide an improvement to the conventional methods for refining wood chips into pulp or individual pulp fibres by mechanical means in a single or double disc refiner. More specifically, the improvement comprises increasing pulp quality by reducing refining intensity in one or more specific refining stages.

It is a particular object of the present invention to control refining intensity in a single refining stage employing low refining intensity.

Another object of the present invention is to control refining intensity in two distinct refining stages employing low refining intensity at least in the second stage of refining.

It is a further object of this invention to control the refining intensity in at least two or more distinct refining stages employing low intensity in at least two of the refining stages, one of the stages being the last.

It is yet another object of the present invention to control refining intensity in two or more distinct refining stages employing low refining intensity in a pre-refining stage and a final refining stage.

It is yet a further object of the invention to control refining intensity in three distinct refining stages employing low refining intensity in each stage.

In a further object of this invention low refining intensity is employed in refining rejects in a single or multiple stage refining operation.

It is yet another object of this invention to provide a method of refining wood chips to wood fibre pulp with monitoring of a fibre quality parameter.

The objects of this invention, to employ low refining intensity in a distinct refining stage or stages can be carried out by rotating the discs of a double disc refiner or the disc of a single disc refiner at rotational speeds that are lower than that conventionally employed.

In accordance with the invention there is provided in a method for mechanical refining of a wood chip composition to produce wood pulp in which the wood chip composition is subjected to at least one refining stage comprising transfer of energy to the wood chip composition under impact of rotating impact members, the improvement in which at least a final stage of said at least one refining stage is carried out in a refiner selected from a double disc refiner or a single disc refiner at a low refining intensity in which the rotating impact members of the double disc refiner rotate at less than 1200 RPM and the rotating impact members of the single disc refiner rotate at less than 1500 RPM.

In accordance with another aspect of the invention there is provided in an apparatus for refining wood chips to wood fibre pulp comprising at least one refiner having a rotatable impact member, a monitor to detect a parameter of the wood fibre pulp and control means to adjust operation of the refiner in response to the detected parameter, to establish a predetermined value of the parameter, the improvement wherein said apparatus additionally includes a motor speed controller effective to control the rate of rotation of the rotatable impact member to vary the intensity of refining in the refiner, in response to a fibre quality parameter detected by said monitor.

In accordance with still another aspect of the invention there is provided a method of refining wood chips to wood fibre pulp comprising: refining wood chips in at lest one refiner having at least one rotatable impact member to produce a product wood fibre pulp, monitoring the product wood fibre pulp to detect a fibre quality parameter of the pulp, and altering the rate of rotation of the at least one rotatable impact member to vary the intensity of refining in the at least one refiner, in response to the fibre quality parameter detected, to establish a predetermined value of the fibre quality parameter in the product wood fibre pulp.

DETAILED DESCRIPTION OF THE INVENTION

The invention provides a refining process capable of improving pulp fibre quality, to the likeness of kraft fibre, by low intensity refining enabled by a speed reduction of the disc or discs in a refiner. This unexpected finding was first discovered while employing low intensity refining at disc speeds of less than 1200 RPM in a single stage refiner.

Subsequently, it has been found that the improvement of pulp-fibre quality is also evident in refining systems employing distinct multiple refining stages provided that at least the final refining stage is carried out at low intensity enabled by a reduction of disc speed to below conventional speeds. It has also been discovered that fibre quality was improved in a multi stage refining system when each refiner in a multiple series was operated at low refining intensity enabled by a reduction of disc speed to less than conventional operating speeds.

Double disc refiners conventionally operate at disc rotations of 1200 RPM or more. In the present invention, when employing a double disc refiner or a plurality of double disc refiners in sequence, the discs rotate at less than 1200 RPM, preferably not more than 1150 RPM, more preferably 850 to 1000 RPM and most preferably about 900 RPM to provide the desired rotation of the impact members which are supported on the rotating discs.

Single disc refiners conventionally operate at a disc rotation of 1500 RPM or more, and typically at 1500 RPM or 1800 RPM. In the present invention, when employing a single disc refiner or a plurality of single disc refiners in sequence, the disc rotates at less than 1500 RPM, preferably not more than 1450 RPM, more preferably at 1100 to 1300 RPM and most preferably at about 1200 RPM.

In practice it is most expedient at present to employ speeds which are multiples of 300 RPM, because equipment manufacturers market disc refiners with motors which provide operational speeds which are multiples of 300 RPM; for example, 900 RPM, 1200 RPM, 1500 RPM and 1800 RPM. In general operating at speeds which are not multiples of 300 RPM requires additional equipment permitting variation of the output of the motor in the commercially available disc refiners.

In general the refining of wood chips to wood pulp comprises breaking the wood chips down into the component fibres, followed by fibre development in which the fibres are fatigued to render them flexible and collapsible.

This invention can also be implemented by applying a constant low intensity, low energy treatment in a pre-refiner by utilizing a fixed rotational speed of less than 900 RPM and preferably at 600 RPM.

The pre-refiner provides a preliminary gentle refining prior to the main refining stage or stages.

In another embodiment of this invention a rejects refiner is operated at low intensity enabled by a reduction in disc speed to less than 1200 RPM to yield pulp fibre of extremely high quality. The rejects are, in particular, screen rejects from a wood chip pulp of the mainline refiners.

All or any combination of the above processes can be implemented to maximize the quality of the pulp fibres to a level heretofore non-existent commercially.

A preferred embodiment applied to existing commercial TMP (thermo-mechanical pulp) refiner installations employing double disc refiners would be the operation of the secondary and/or tertiary refiner in such an installation at low intensity enabled by a reduction in disc speed to less than 1200 RPM. In the commercial installation the refining intensity is too high for the fibres at that point in their development. It has been discovered that by employing low refining intensity according to this invention the secondary and/or tertiary refiner can be fully loaded when required.

In each of the above cases low intensity refining is enabled by a speed reduction of the disc refiner which typically is achieved by known means in the art such as a variable frequency AC drive, a gear box or a simple set speed motor design, whichever is most appropriate.

The present invention is not necessarily directed to saving refining energy per se, although some energy saving can be achieved. The invention has major application in that it may be used to direct energy towards fibre quality development rather than fibre damage, as is the case with conventional refining systems.

In an apparatus embodiment of the present invention employing a double disc refiner one or both discs is rotated at less than 1200 RPM and preferably at 900 RPM in order to achieve a desired low refining intensity required to direct the applied energy towards fibre quality development.

In another apparatus embodiment of this invention employing a single disc refiner the disc is rotated at less than the conventional 1800 RPM or 1500 RPM, and more especially at less than 1500 RPM.

Thus, there is provided in the present invention a variety of novel features which can afford significantly greater on-line control of the refining process to produce quality fibre.

Additionally, pulp quality control can be greatly enhanced through feedback adjustments of motor rotational speed, i.e., refining intensity. Indeed this will provide another variable, besides specific energy, that can be manipulated to control pulp properties. This will give the possibility to independently control on-line two of the pulp properties such as freeness and average fibre length which is an advantage over conventional control where only one variable, specific energy, is adjusted to control only one pulp property such as freeness.

In a typical refiner installation a device is employed which monitors pulp quality by measuring fibre length and specific surface or freeness and maintains a set quality standard by motor load, for example, by plate gap adjustment. If, now, for example, with the present invention the fibre length is sensed as being too low, a signal is sent to the motor speed controller of the refiner, to reduce RPM thereby lowering refining intensity and thus restoring fibre length to a preset value. Such monitoring devices are commercially available. Other fibre quality parameters may be sensed in the same way, for example, flexibility or coarseness and a signal sent to the motor speed controller to change the RPM to restore the quality parameter to a desired level.

EXAMPLES

Pilot plant trials to study low intensity refining were conducted on an atmospheric 36 inch double disc refiner which in conventional operation utilizes a disc rotational speed of 1200 RPM. All experiments were done with standard Bauer pattern 36104 refiner plates. A constant discharge consistency of 25 percent was maintained throughout the investigation and, unless otherwise noted, all chip refining was done with black spruce chips which had been pre-steamed at 138° C. for 10 minutes.

Figure 1:
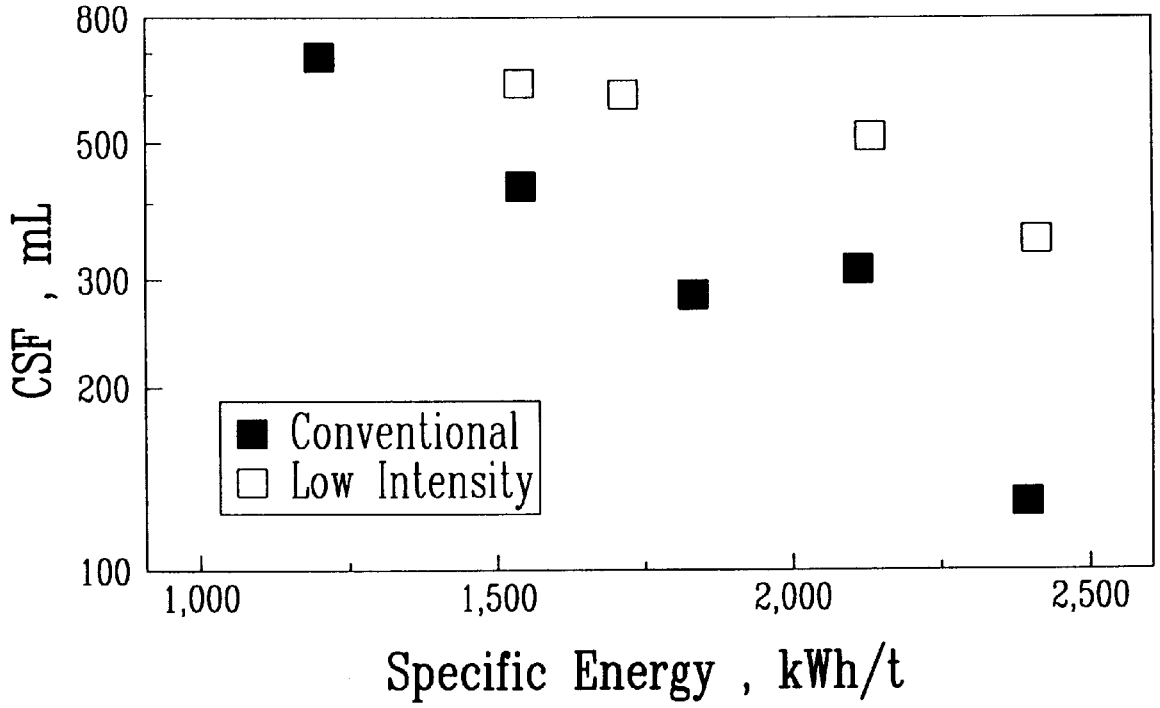
FIG. 1. Illustrates graphically how low intensity single stage refining at 900 RPM permits higher energy to be applied at a given freeness than conventional single stage refining at 1200 RPM.
Figure 2:
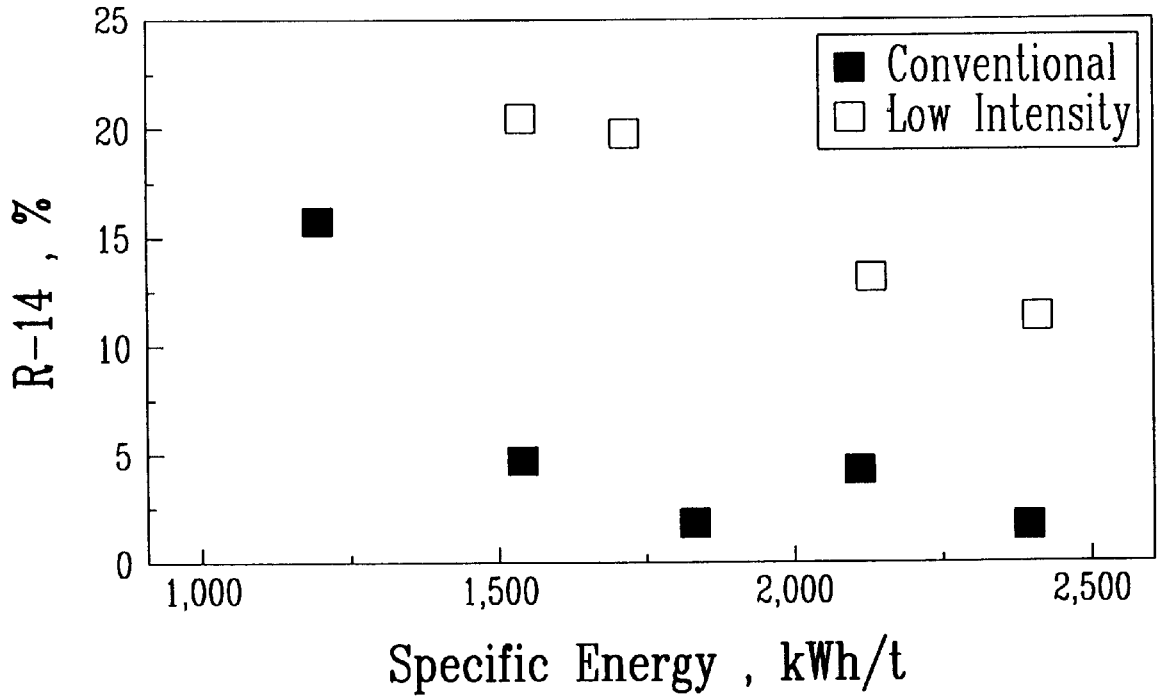
FIG. 2. Illustrates graphically how in single stage low intensity refining more long fibres are retained at a given specific energy than in conventional single stage refining.

In FIG. 1, freeness has been plotted against specific energy to compare conventional single stage refining with a double disc refiner at a disc speed of 1200 RPM, to low intensity single stage refining at a disc speed of 900 RPM. At the same freeness, the pulp made at the low refining intensity requires more energy than that produced with conventional conditions. This is because low intensity refining promotes fibre development, rather than fibre cutting, as shown by the plot of long fibre content against specific energy in FIG. 2.

Figure 3:
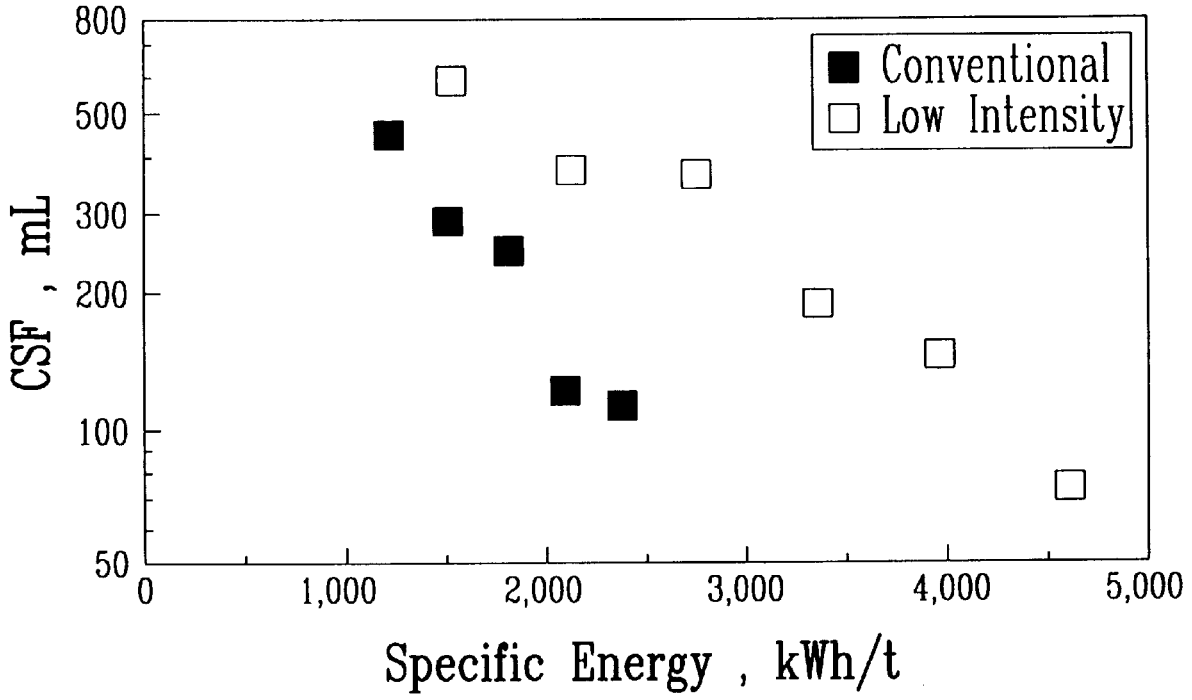
FIG. 3 Illustrates graphically how more energy can be put into the pulp at a given freeness by low intensity refining at 600, 900 and 900 RPM in three distinct stages as compared to conventional 1200 RPM refining.
Figure 4:
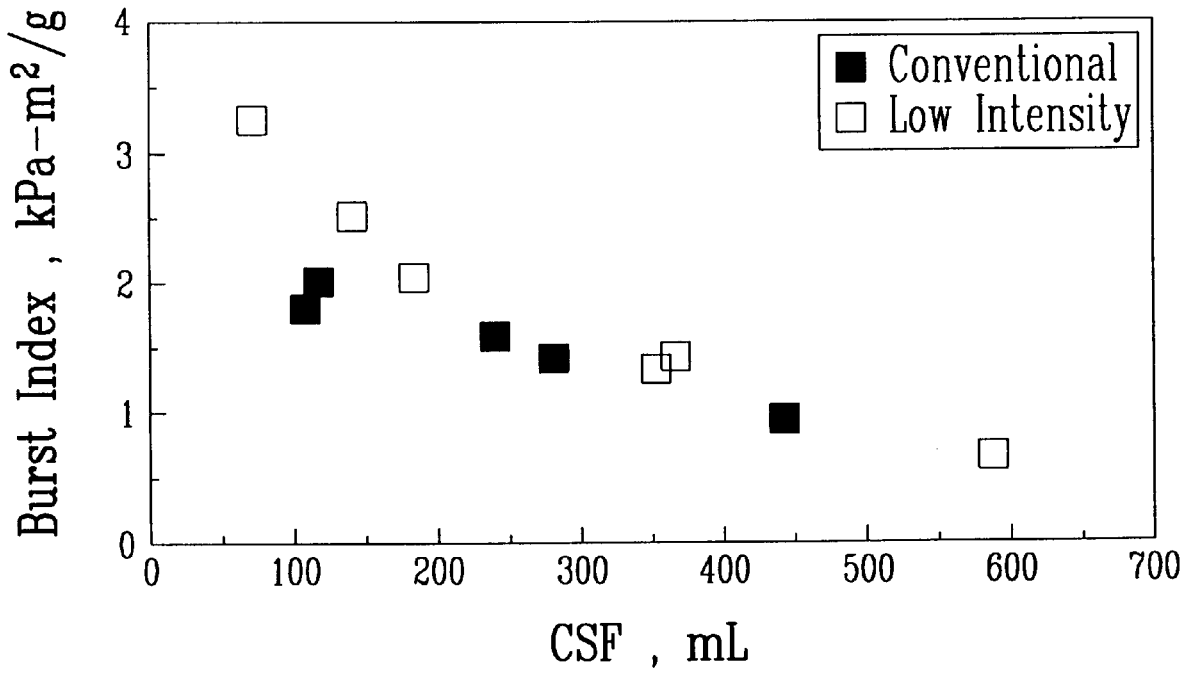
FIG. 4 Illustrates graphically similar burst/freeness relationships obtained with three stage low intensity refining and conventional refining.
Figure 5:
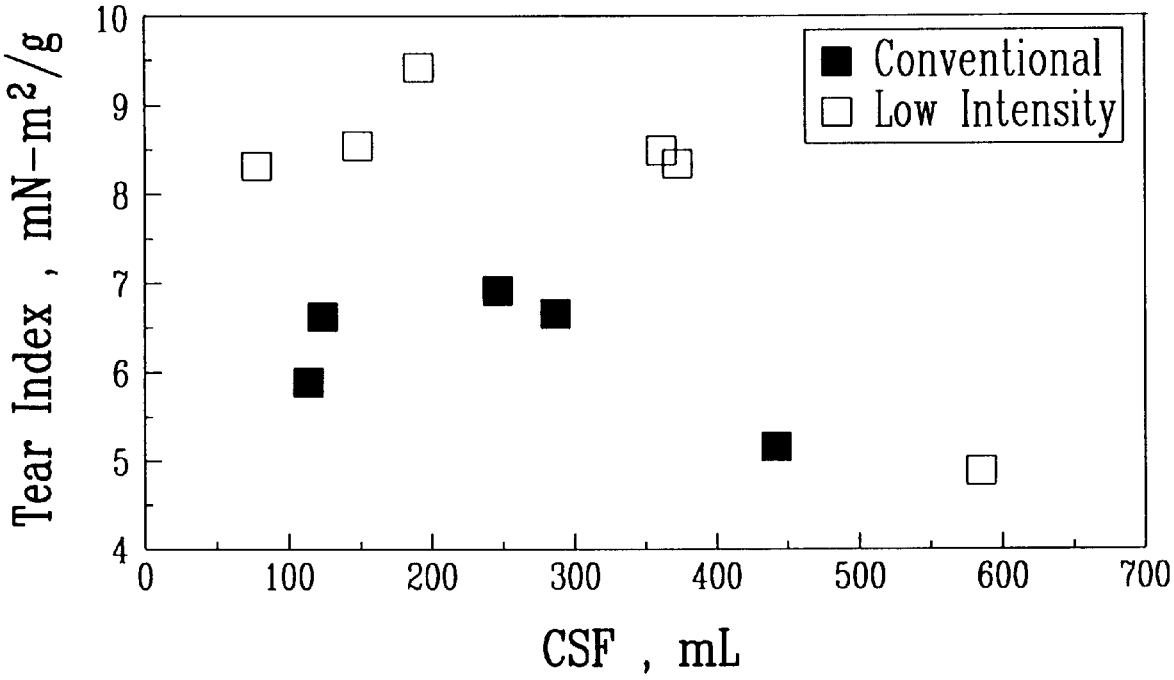
FIG. 5 Illustrates graphically that three stage low intensity refining can provide substantially higher tear strength than conventional refining.
Figure 6:
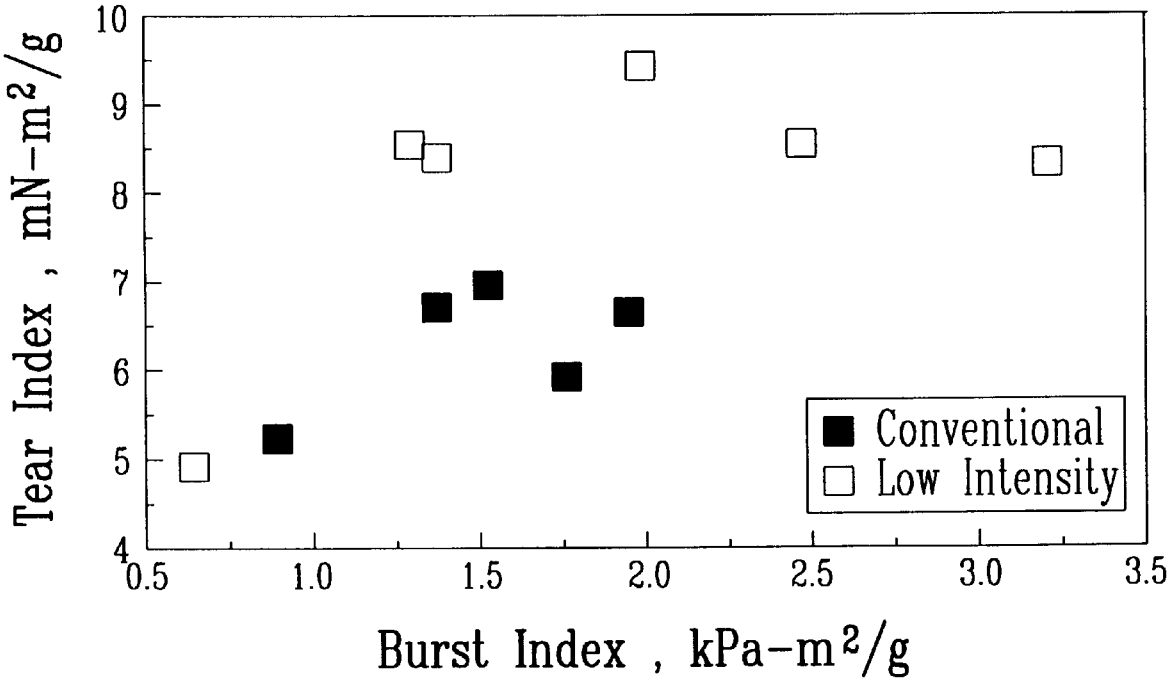
FIG. 6 Illustrates graphically that three stage low intensity refining increases tear/burst levels over conventional refining.

Higher energy consumption to a given freeness is also evident in FIG. 3 which compares a single stage of conventional refining with a double disc refiner at 1200 RPM to three stages of low intensity refining with disc speeds of 600, 900, and 900 RPM in the first, second, and third stages, respectively. The conventional and low intensity pulps have the same burst-fieeness relationship, as shown in FIG. 4 which demonstrates that more energy can be applied to the pulp with low intensity refining than conventional refining. The tear index of pulp made with low intensity refining is significantly higher than that made at conventional intensity as shown in FIG. 5. Low intensity refining gives both a higher tear index and burst than refining at conventional intensity, as shown in FIG. 6.

Figure 7:
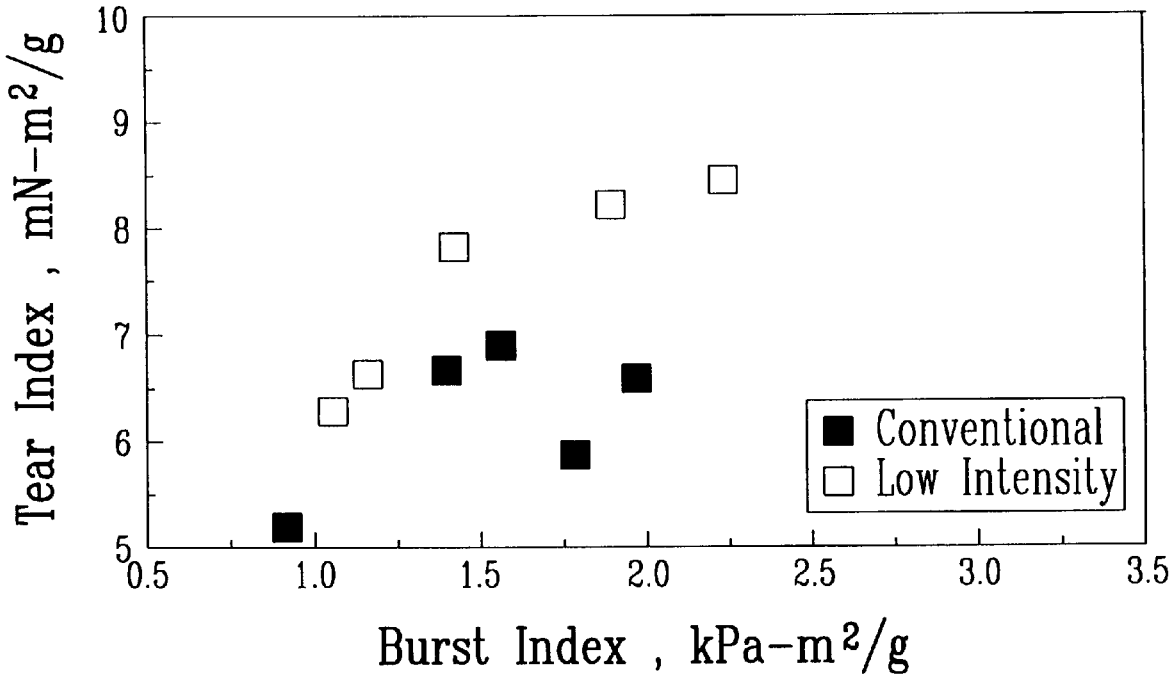
FIG. 7 Illustrates graphically how, using pre-steamed chips and two stages of low intensity refining at 900 RPM produces better pulp quality than two stage conventional refining at 1200 RPM.
Figure 8:
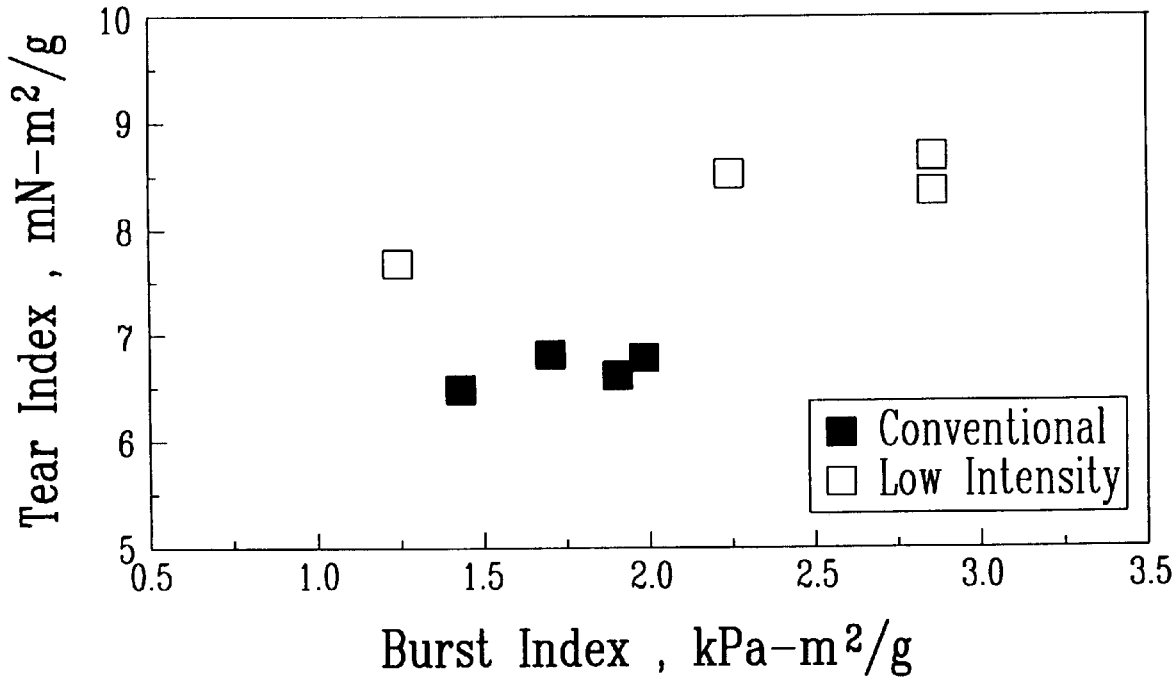
FIG. 8 Illustrates graphically how without chip pre-steaming, two stages of low intensity refining at 900 RPM produces better pulp quality than two stage conventional refining at 1200 RPM.

Operating both the primary and secondary double disc refiners at lower intensity produced by disc speeds of 900 RPM produces pulp with both a higher burst and tear than primary and secondary stages operated at conventional intensity as shown in FIG. 7. Similar trends are obtained when no chip presteaming is done, as shown in FIG. 8.

Figure 9:
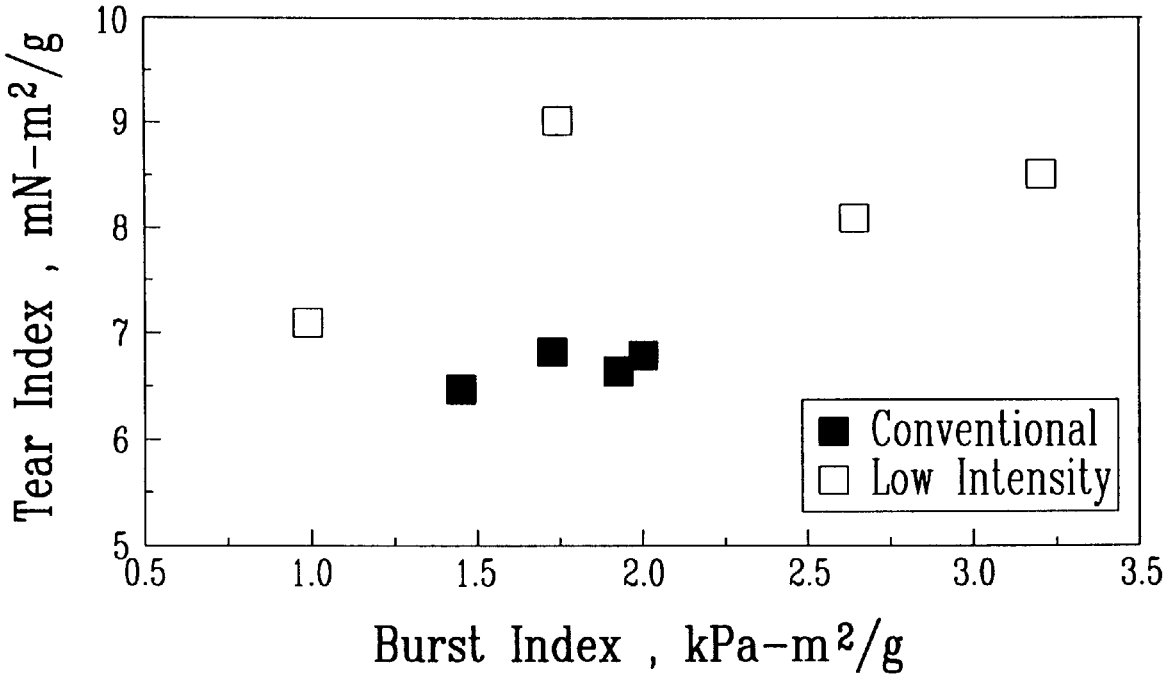
FIG. 9 Illustrates graphically how, in two stage refining, better pulp is produced when the 1200 RPM primary stage is followed by low intensity secondary refining at 900 RPM instead of conventional secondary refining at 1200 RPM.

It has also been found that strength properties can be enhanced in two stage refining by operating the primary refiner of a double disc refiner at conventional intensity, for example, at a disc speed of 1200 RPM followed by low intensity treatment in the secondary refiner at a disc speed of 900 RPM, as shown in FIG. 9. No chip presteaming was used in this test.

Figure 10:
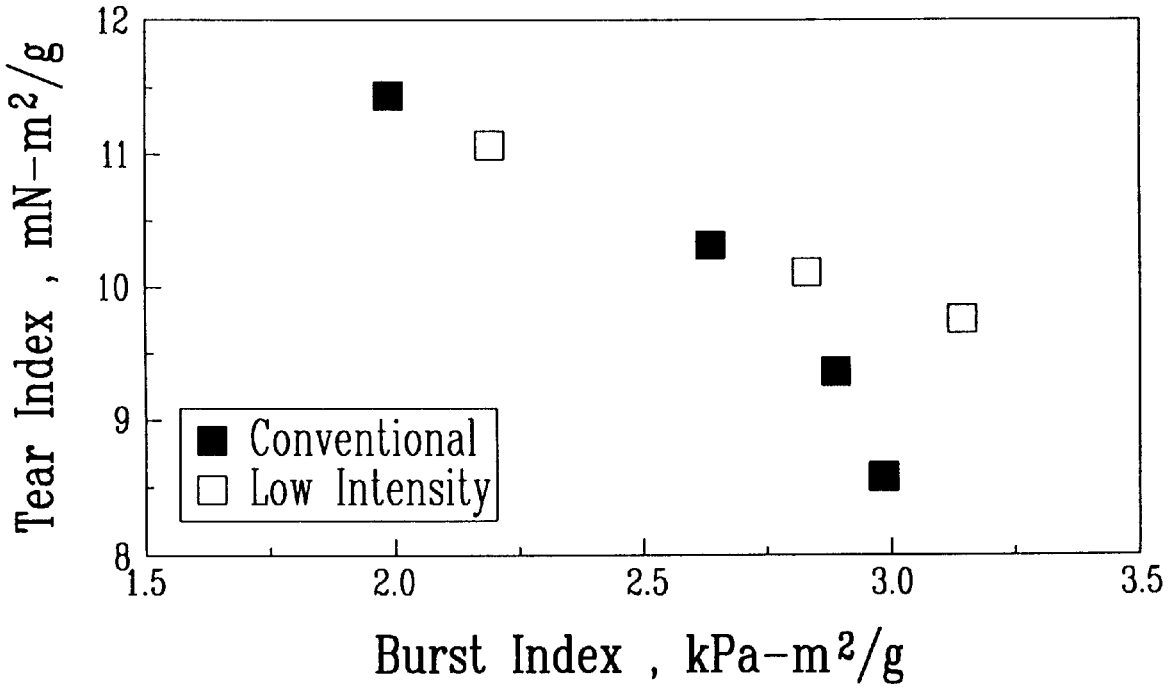
FIG. 10 Illustrates graphically that better pulp quality is obtained when TMP rejects are given low intensity refining at 900 RPM than when conventionally refined at 1200 RPM.

In the production of thermomechanical pulp (TMP), it is common to separate underdeveloped fibres and fibre bundles after primary, secondary, or tertiary refining by screening or cleaning, for further refining in a rejects refiner. The pulp produced by the rejects refiner is of high quality because it contains a larger portion of long fibre than that produced by the mainline refiners. Material that was directed towards a reject refiner in a commercial mill was collected for controlled pilot plant experiments. As shown in FIG. 10, by refining employing a double disc refiner at lower intensity with a disc speed of 900 RPM, it was possible to put more energy into the pulp and achieve a higher burst value at a given tear than refining at conventional intensity employing a disc speed of 1200 RPM.

Figure 11:
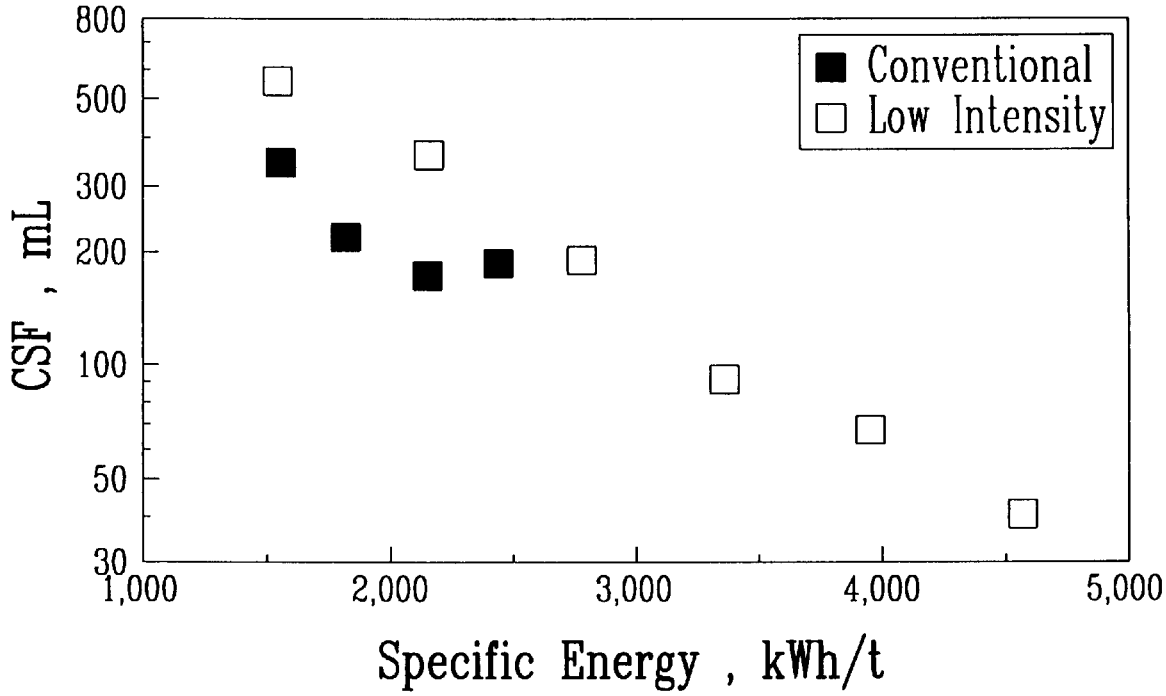
FIG. 11 Illustrates graphically how using three distinct stages of low intensity refining at 600, 900, and 900 RPM permits more energy to be applied to jack pine than conventional refining at 1200 RPM.
Figure 12:
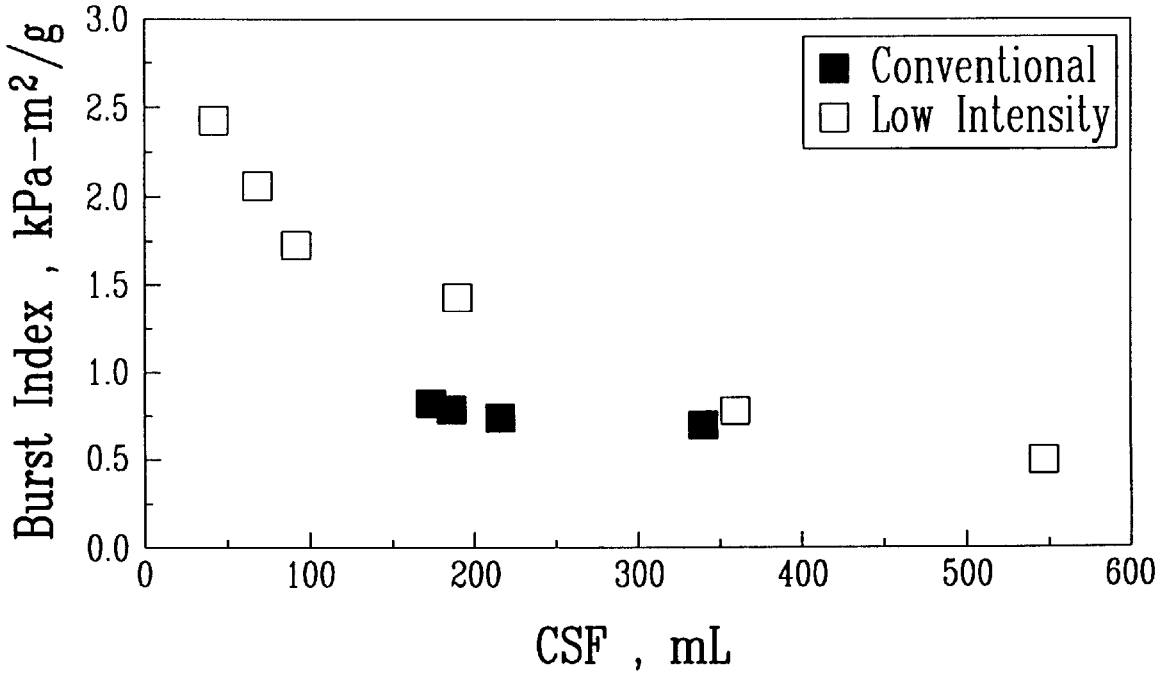
FIG. 12 Illustrates graphically the refining operation of FIG. 11 to show that, at the same freeness, jack pine burst is improved by refining at low intensity.
Figure 13:
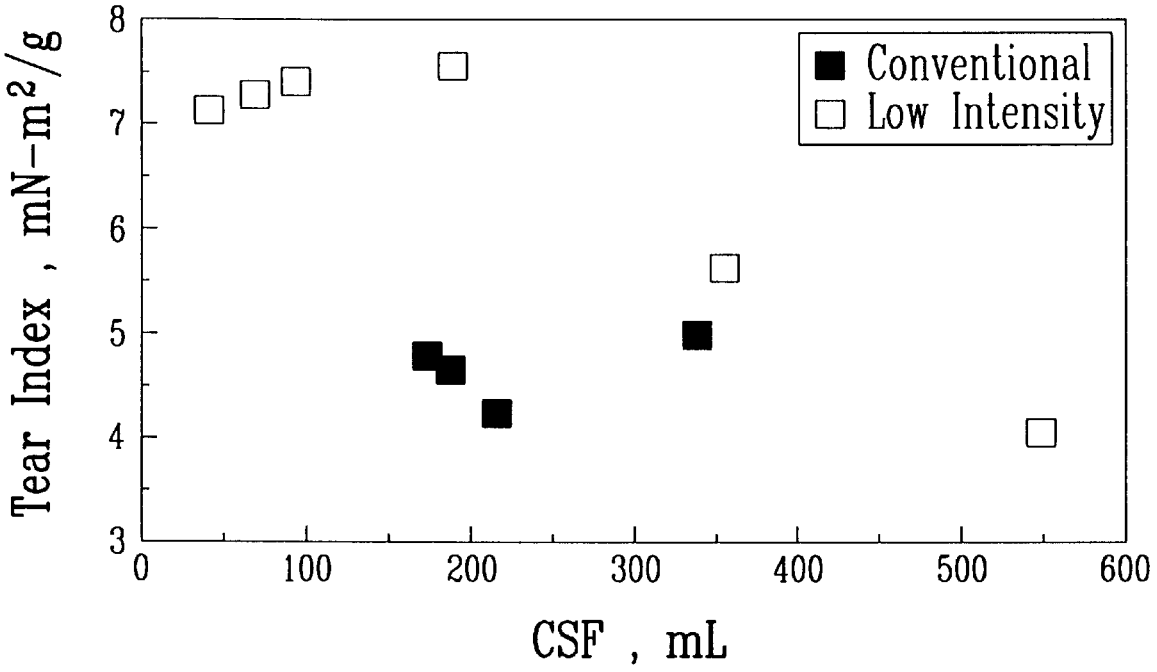
FIG. 13 Illustrates graphically the refining operation of FIG. 11 to show that, at the same freeness, jack pine tear is improved by refining at low intensity.
Figure 14:
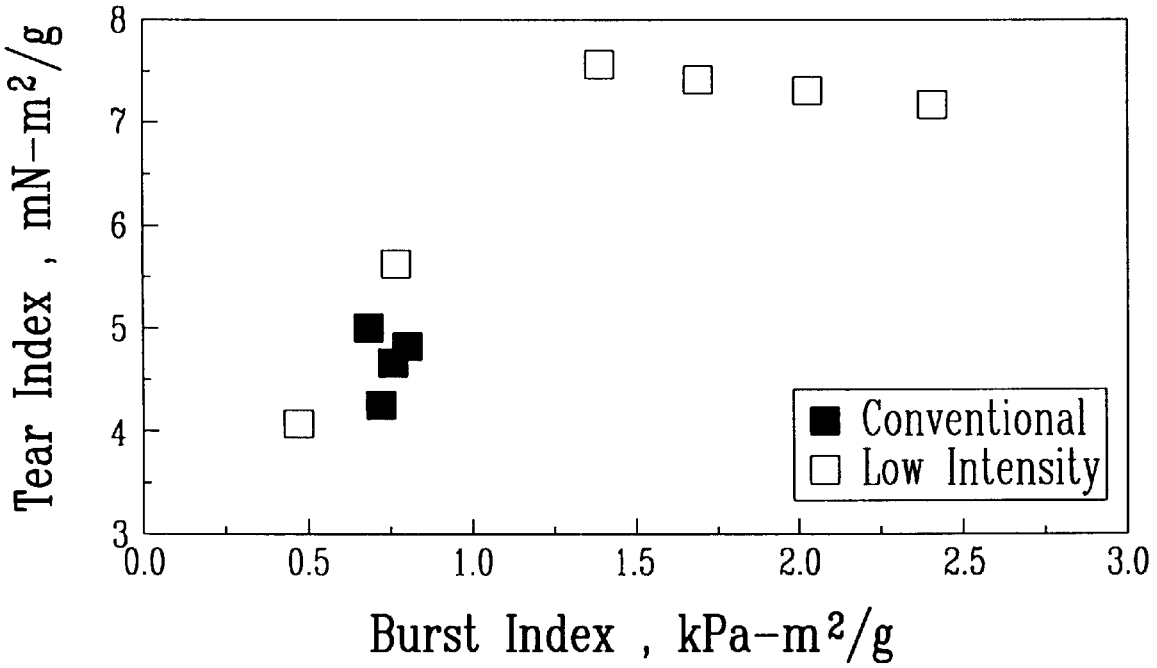
FIG. 14 Illustrates graphically the refining operation of FIG. 11 to show that tear strength of jack pine at a given burst value is much better when refining at low intensity than conventional refining.

Further pilot plant experiments were conducted to demonstrate that the low intensity process of the invention also improves properties of pulp made from different wood species, particularly those that are under-utilized because of relatively poor fibre properties. The pulp quality of jack pine produced at conventional refining intensity in a double disc refiner at a disc speed of 1200 RPM was compared to that produced with a low energy, low intensity pre-refining stage at 600 RPM followed by two stages of low intensity refining at 900 RPM. As shown in FIG. 11, low intensity refining may require more energy to reach a given freeness than refining at conventional intensity, however, at a given freeness, the burst index of the conventional jack pine pulp is lower than that produced with the low intensity process as shown in FIG. 12. The tear index of the low intensity jack pine pulp is greater than that produced at conventional intensity at freeness values below 200 ml CSF, which is in the range of commercial interest as shown in FIG. 13. The low intensity process produces a jack pine pulp with much greater tear and burst index than can be produced with refiners operating at conventional intensity as shown in FIG. 14.

Figure 15:
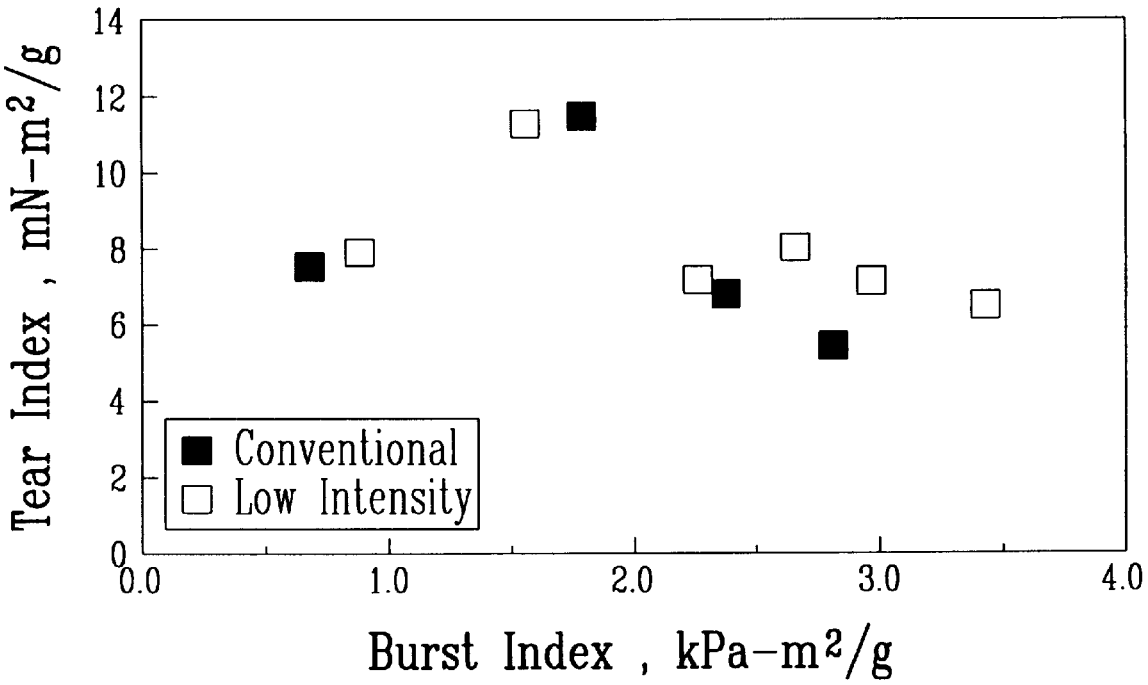
FIG. 15 Illustrates graphically that, at a sulphonate content of 2 percent (140 g/l solution), low intensity CMP refining permits higher tear strength to be obtained at high burst values.
Figure 16:
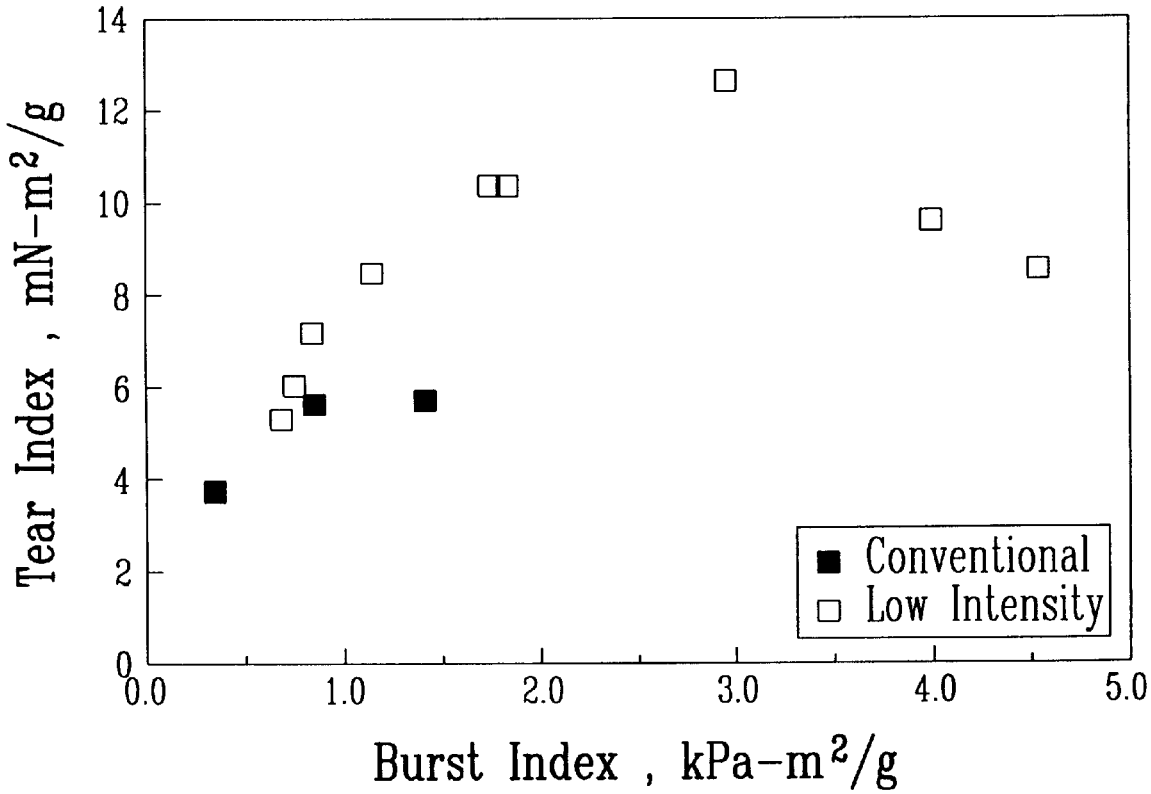
FIG. 16 Illustrates graphically that, at a sulphonate content of 0.9 percent (35 g/l solution), low intensity CMP refining gives greatly enhanced tear strength, similar to that of conventional refining at 2 percent sulphonate content.

In the production of chemimechanical pulp (CMP), the use of low intensity refining can also lead to enhanced properties. The results in FIG. 15 show that chips impregnated with a 140 g/l solution to give a 2 percent sulphonate content provide more tear at high burst levels using two stage, low intensity refining in a double disc refiner at 900 RPM than could be obtained by conventional refining at 1200 RPM. A similar plot is shown in FIG. 16, for a solution of 35 g/l and a sulphonate content of 0.9 percent. Low intensity refining results in much higher tear strength, comparable to conventional refining at 2 percent sulphonate content.

Figure 17:
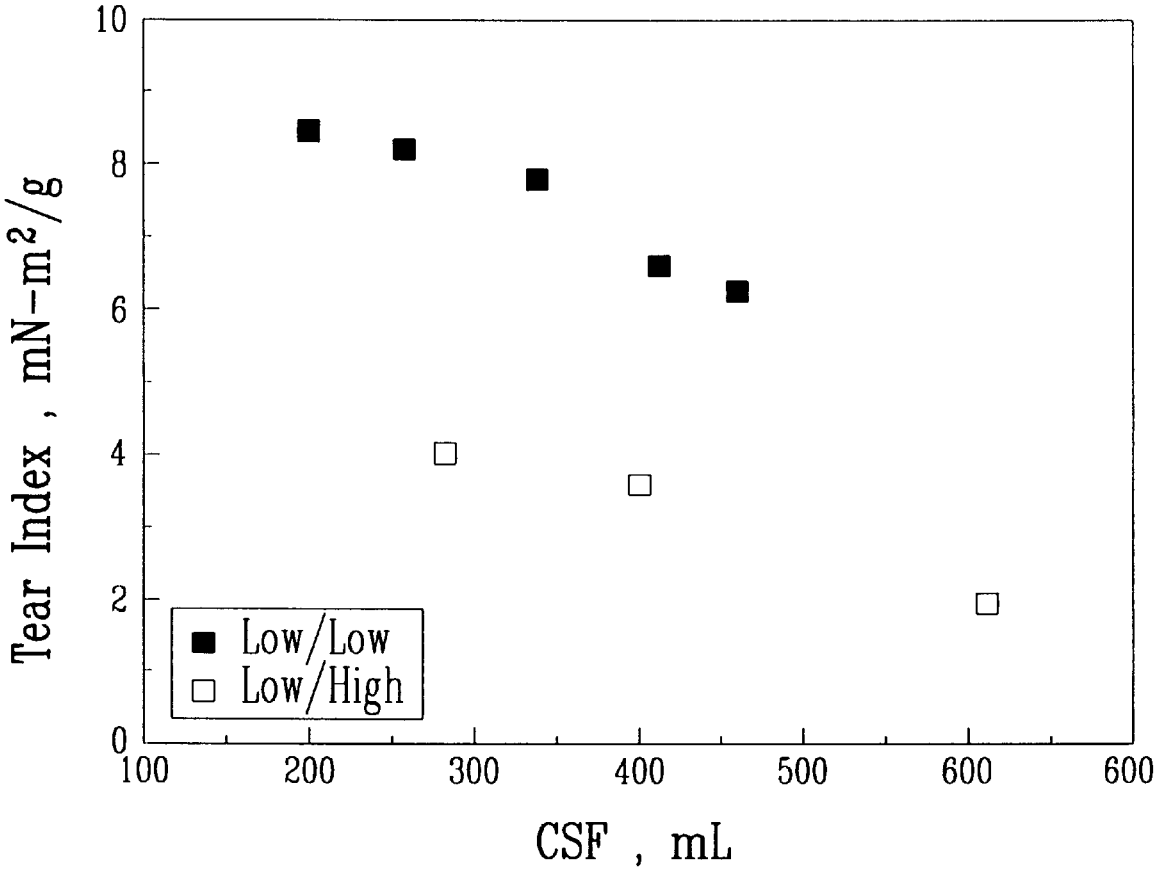
FIG. 17 Illustrates graphically a comparison of results achieved employing two sequential low intensity refining stages in accordance with the invention, and a comparison in which a lower intensity stage is followed by a high intensity stage.

FIG. 17 shows pulp properties achieved employing low intensity refining in two stages employing double disc refiners at 900 RPM in accordance with the invention, in comparison with the properties achieved employing a first low intensity stage at 900 RPM followed by a second high intensity stage at 1800 RPM as contemplated in U.S. Pat. No. 5,540,392. The properties achieved with the method of the invention are markedly superior to those in the comparison and in particular the high intensity final stage of the comparison results in fibre damage which leads to loss of tear strength.

Variable refining intensity can provide improved quality control if the motor speed on at least the last refining stage is adjustable. For example, the schematic diagram in FIG. 18 combines secondary refiner speed control with on line measurement of freeness and fibre length. Thus, when freeness is too high motor load is increased by plate gap adjustment, while fibre length is maintained by reducing refining intensity by lowering the rotational speed according to this invention.

Figure 18:
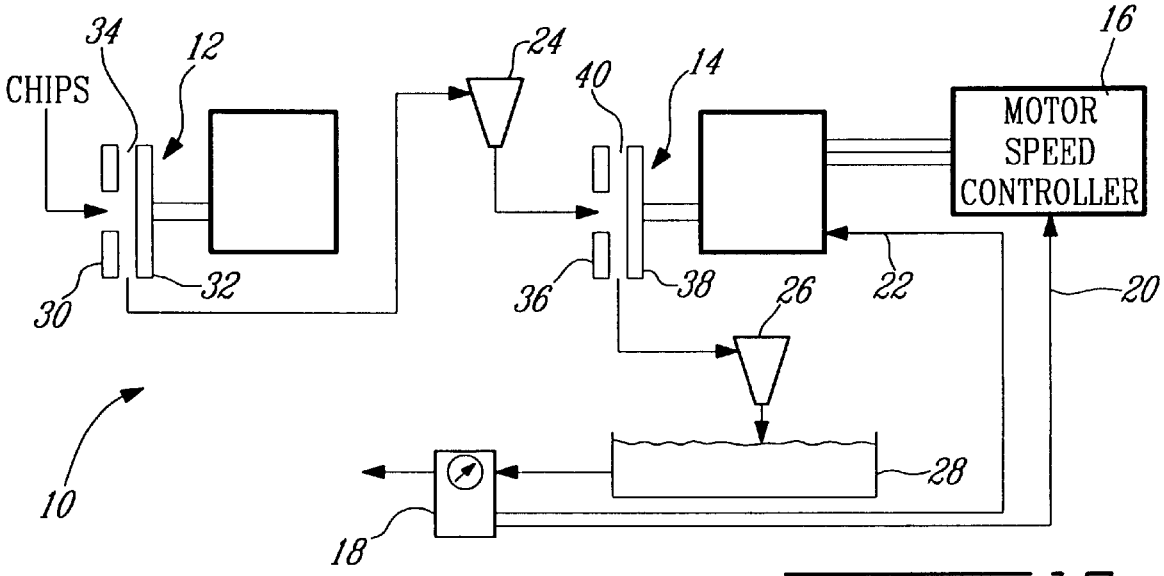
FIG. 18 Is a schematic of a control system for practicing the method of the present invention in accordance with one embodiment thereof.

With further reference to FIG. 18, there is illustrated schematically a system 10 for refining wood chips with on-line quality control by feedback adjustment of refiner speed, i.e., refining intensity.

System 10 includes a first stage single disc refiner 12, a second stage single disc refiner 14, a motor speed controller 16 and a monitor 18 which monitors freeness and fibre length of product pulp.

A line 20 communicates monitor 18 with controller 16 and a line 22 communicates monitor 18 with a load or power control of secondary refiner 14.

System 10 additionally includes cyclones 24 and 26 and a latency chest 28.

Refiner 12 has a stationary disc 30 and a rotating disc 32 with a gap 34 therebetween and refiner 14 has a stationary disc 36 and a rotating disc 38 with a gap 40 therebetween.

In operation, aqueous wood chips are fed to gap 34 between disc 30 and 32 in refiner 12, refining takes place in gap 34 as disc 32 rotates, the resulting aqueous composition is fed from refiner 12 to cyclone 24 where an aqueous wood chip/pulp composition is separated from steam and fed to the gap 40 between discs 36 and 38 in refiner 14.

Further refining takes place in refiner 14 as disc 38 rotates and the resulting composition is fed to cyclone 26 where steam is separated from the pulp, the pulp from cyclone 26 is fed to latency chest 28, in conventional manner, where the pulp is agitated to straighten the fibres.

The resulting pulp is monitored for freeness and fibre length by monitor 18; in response to the fibre length monitored the speed of rotation of disc 38 may be altered by controller 16. If the fibre length monitored is too short the rotation of disc 38 is lowered by controller 16 to reduce the refining intensity. This represents a novel aspect of the present invention. The load or power of operation of refiner 14 may similarly be altered in conventional manner, in response to the freeness monitored by monitor 18.

Freeness and fibre length are given only as an example of the properties that can be controlled independently of each other. However, other measured on-line pulp properties such as specific surface and tear could also be used. The control scheme is given as an example of a scheme by which the invention is used to control two pulp properties by manipulation of rotational speed and specific energy.

What is claimed is:

1. In a method for mechanical refining of a wood chip composition at high consistency to produce wood pulp in which the wood chip composition is subjected to a refining step comprising at least one refining stage comprising transfer of energy to the wood chip composition under impact with rotating impact members of a double disc refiner for each refining stage, the improvement in which at least a final refining stage of said refining step is carried out in a double disc refine at a low refining intensity in which the rotating impact members of the double disc refiner rotate at less than 1200 RPM and the remaining refining stages of said refining step are each at a refining intensity in which the rotating impact members rotate at not more than 1200 RPM, to produce a wood pulp of improved pulp-fiber quality.

2. A method according to claim 1, in which said low refining intensity is at not more than 1150 RPM.

3. A method according to claim 2, wherein said low refining intensity is at 850 to 1000 RPM.

4. A method according to claim 3, wherein said low refining intensity is at 900 RPM.

5. A method according to claim 2, wherein said refining step is carried out at an energy input of at least 3500 kWh/t of wood chip composition, and a wood pulp is recovered from the final stage of improved pulp-fiber quality having a freeness below 200 ml CSF.

6. A method according to claim 1, in which said at least one refining stage consists of a single low intensity refining stage.

7. A method according to claim 1, wherein said at least one refining stage comprises a plurality of discrete refining stages.

8. A method according to claim 7, wherein said plurality is 2.

9. A method according to claim 8, wherein both refining stages are low intensity refining stages.

10. A method according to claim 7, wherein said plurality is at least 3, and at least two of the refining stages are low intensity refining stages.

11. A method according to claim 7, wherein said plurality is 3, each of said refining stages being low intensity refining stages.

12. A method according to claim 1, wherein said wood chip composition is a screen rejects from a wood chip pulp of a main line refiner.

13. A method according to claim 1, wherein said wood composition is subjected to a pre-refining prior to said at least one refining stage, at less than 900 RPM.

14. A method according to claim 13, wherein said pre-refining is at 600 RPM.

15. A method according to claim 1, wherein each refining stage of said refining step is at a said low refining intensity in which the rotating impact members of a double disc refiner rotate at less than 1200 RPM.

16. A method according to claim 15, wherein the rotating impact members of each double disc refiner rotate at 850 to 1000 RPM.

17. In an apparatus for refining wood chips to wood fibre pulp comprising at least one refiner having a rotatable impact member, a monitor to detect a parameter of the wood fibre pulp and control means to adjust operation of the refiner in response to the detected parameter, to establish a predetermined value of the parameter, the improvement wherein said apparatus additionally includes a motor speed controller effective to control the rate of rotation of the rotatable impact member to vary the intensity of refining in the refiner, in response to a fibre quality parameter detected by said monitor.

18. An apparatus according to claim 17, wherein the fibre quality parameter is length, flexibility or coarseness detected by the monitor.

19. A method of refining wood chips to wood fibre pulp comprising:

refining wood chips in at least one refiner having at least one rotatable impact member to produce a product wood fibre pulp, monitoring the product wood fibre pulp to detect a fibre quality parameter of the pulp, and altering the rate of rotation of the at least one rotatable impact member to vary the intensity of refining in the at least one refiner, in response to the fibre quality parameter detected, to establish a predetermined value of the fibre quality parameter in the product wood fibre pulp.

20. A method according to claim 19, wherein the fibre quality parameter monitored is fibre length, flexibility or coarseness.

21. In a method for mechanical refining of a wood chip composition at high consistency to produce wood pulp in which the wood chip composition is subjected to a refining step comprising at least one refining stage comprising transfer of energy to the wood chip composition under impact with rotating impact members of a single disc refiner for each refining stage, the improvement in which at least a final refining stage of said refining step is carried out in a single disc refiner, at a low refining intensity in which the rotating impact members of the single disc refiner rotate at less than 1500 RPM, and the remaining refining stages of said refining step are each at a refining intensity in which the rotating impact members rotate at not more than 1500 RPM, to produce a wood pulp of improved pulp-fiber quality.

22. A method according to claim 21, in which the low refining intensity is at not more than 1450 RPM.

23. A method according to claim 22, wherein said low refining intensity is at 1100 to 1300 RPM.

24. A method according to claim 23, wherein said low refining intensity is at 1200 RPM.

25. A method according to claim 22, wherein said refining step is carried out at an energy input of at least 3500 kWh/t of wood chip composition, and a wood pulp is recovered from the final stage, of improved pulp-fiber quality having a freeness below 200 ml CSF.

26. A method according to claim 21, in which said at least one refining stage consists of a single low intensity refining stage.

27. A method according to claim 21, wherein said at least one refining stage comprises a plurality of discrete refining stages.

28. A method according to claim 27, wherein said plurality is 2.

29. A method according to claim 28, wherein both refining stages are low intensity refining stages.

30. A method according to claim 27, wherein said plurality is at least 3, and at least two of the refining stages are low intensity refining stages.

31. A method according to claim 28, wherein said plurality is 3, each of said refining stages being low intensity refining stages.

32. A method according to claim 21, wherein said wood chip composition is a screen rejects from a wood chip pulp of a main line refiner.

33. A method according to claim 21, wherein each refining stage of said refining step is at a said low refining intensity in which the rotating impact members of a single disc refiner rotate at less than 1500 RPM.

34. A method according to claim 33, wherein the rotating impact members of each single disc refiner rotate at 1100 to 1300 RPM.

35. In a method for mechanical refining of a wood chip composition at high consistency to produce wood pulp in which the wood chip composition is subjected to a refining step comprising at least one refining stage comprising transfer of energy to the wood chip composition under impact with rotating impact members, the improvement in which at least a final stage of said refining step is carried out in a double disc refiner at a low refining intensity in which the rotating impact members of the double disc refiner rotate at less than 1200 RPM to produce a wood pulp of improved pulp-fiber quality having a freeness below 200 ml CSF, and said refining step is carried out at an energy input of at least 3000 kWh/t of wood chip composition.

36. A method according to claim 35, in which said low refining intensity is at not more than 1150 RPM.

37. A method according to claim 36, wherein said low refining intensity is at 850 to 1000 RPM.

38. A method according to claim 37, wherein said low refining intensity is at 900 RPM.

39. A method according to claim 35, in which said at least one refining stage consists of a single low intensity refining stage.

40. A method according to claim 35, wherein said at least one refining stage comprises a plurality of discrete refining stages.

41. A method according to claim 35, wherein said energy input is at least 3500 kWh/t.

42. In a method for mechanical refining of a wood chip composition at high consistency to produce wood pulp in which the wood chip composition is subjected to a refining step comprising at least one refining stage comprising transfer of energy to the wood chip composition under impact with rotating impact members, the improvement in which at least a final stage of said refining step is carried out in a single disc refiner at a low refining intensity in which the rotating impact members of the single disc refiner rotate at less than 1500 RPM to produce a wood pulp of improved pulp-fiber quality having a freeness below 200 ml CSF and said refining step is carried out at an energy input of at least 3000 kWh/t of wood chip composition.

43. A method according to claim 42, in which the low refining intensity is at not more than 1450 RPM.

44. A method according to claim 43, wherein said low refining intensity is at 1100 to 1300 RPM.

45. A method according to claim 44, wherein said low refining intensity is at 1200 RPM.

46. A method according to claim 42, in which said at least one refining stage consists of a single low intensity refining stage.

47. A method according to claim 42, wherein said at least one refining stage comprises a plurality of discrete refining stages.

48. A method according to claim 42, wherein said energy input is at least 3500 kWh/t.

49. In a method for mechanical refining of wood chip composition at high consistency to produce wood pulp in which the wood chip composition is subjected to a plurality of refining stages comprising transfer of energy to the wood chip composition under impact with rotating impact members of at least one double disc refiner or rotating impact members of at least one single disc refiner, the improvement in which at least a final stage of said plurality is carried out at a low refining intensity in which the rotating impact members of a double disc refiner rotate at less than 1200 RPM or the rotating impact members of the single disc refiner.

50. A method according to claim 49, wherein said final stage is carried out in a double disc refiner in which said low refining intensity is at not more than 1150 RPM.

51. A method according to claim 49, wherein said final stage is carried out in a single disc refiner in which said low refining intensity is at not more than 1450 RPM.

* * * * *